United States Patent [19]

Thekdi et al.

[11] 4,310,302

[45] Jan. 12, 1982

[54] BATCH COIL ANNEALING FURNACE BASEPLATE

[75] Inventors: Arvind C. Thekdi, Sylvania; Robert W. Buchwald, Toledo, both of Ohio; Robert A. Schmall, Temperance, Mich.

[73] Assignee: Midland-Ross Corporation, Cleveland, Ohio

[21] Appl. No.: 135,214

[22] Filed: Mar. 28, 1980

[51] Int. Cl.[3] ..... F27B 5/04; F27B 11/00; C21D 1/12

[52] U.S. Cl. ..... 432/205; 266/263; 432/206; 432/260

[58] Field of Search ..... 432/4, 5, 9, 21, 205, 432/206, 254.1, 260; 266/256, 263

[56] References Cited

U.S. PATENT DOCUMENTS

| | | | |
|---|---|---|---|
| 2,489,012 | 11/1949 | Dailey, Jr. | 181/269 |
| 3,113,766 | 12/1963 | Guingand | 432/206 |
| 3,140,743 | 7/1964 | Cone | 266/256 |
| 3,309,073 | 3/1967 | Guingand | 432/206 |

FOREIGN PATENT DOCUMENTS

| | | | |
|---|---|---|---|
| 1555021 | 11/1979 | United Kingdom | 266/256 |

*Primary Examiner*—John J. Camby
*Attorney, Agent, or Firm*—Richard A. Negin

[57] ABSTRACT

The present invention is a method and apparatus for heat treating at least one work item, such as a coil, having an axial passage and being axially stacked on a base support means disposed within a cover means which is located on the base support means. The base support can be on the floor of a furnace and with the chamber of the furnace. A means to force the atmosphere such as an axial fan is located in the base. The atmosphere is forced axially from the base, up through an axial path including the axial passage of the at least one coil, through a top space between the top of the stack of coils and the top of the cover means, down through the annular space between the outside of the coils and the inside of the cover means, and back to the axial path through a base space beneath the at least one coil, communicating from the annular space to the axial path.

4 Claims, 6 Drawing Figures

BATCH COIL ANNEALING FURNACE BASEPLATE

BACKGROUND OF THE INVENTION

This invention is in the field of methods and apparatus for heat treatment operations. More particularly, the invention relates to batch coil annealing furnaces and will be described with particular reference thereto. However, it will be appreciated by those skilled in the art that the invention may generally be applied to heat treating operations where at least one work item having an axial passage is placed within an enclosure in a heat transfer relationship with a heating and cooling media within the enclosure.

Annealing of metal strips and the like is generally accomplished by winding the strips into coils having an axial passage bounded by the inner diameter of the winding. Several coils can be stacked on top of one another and are sealingly enclosed in an inner cover. The inner cover is enclosed in an outer furnace chamber. This may be accomplished in single-stand or multi-stand batch coil annealing furnaces. Heat is transferred through the outer furnace chamber to heat the inner covers which in turn transfer the heat to the coils. A proper annealing atmosphere is maintained in the inner covers. The primary mode of heat transfer from the cover to the coils is by radiation. Additionally, the atmosphere is circulated within the inner cover to achieve more rapid and uniform heat transfer by convection.

Coils are stacked coaxially upon one another within the cover with the axial passage of each coil aligned to form an axial path. A radial fan in the base of the furnace is aligned with the axial path and forces the inner cover atmosphere radially away from the center of the cover, through a base space which communicates from the radial fan, to the annular space between the stack of coils and the inner cover wall. The atmosphere passes up through a top space between the top of the coils and the top of the inner cover and back down to the fan through the axial path in the center of the stack of coils.

Even with the use of the radial fan, there is non-uniform heat transfer and the rate of annealing is limited. The atmosphere heats as it rises in the annular space between the coils and inner cover and is hottest when it reaches the top of the stack of coils. The top outside corner of the top coil is exposed to the radiant energy from the side and the top of the inner cover and is the hottest spot in the stack of coils. The hot atmosphere is forced down through the axial path and cools as it descends to the fan. The top coil, therefore, sees an unequal and greater amount of heat than the lower coils, as one moves progressively down a stack. This problem is compounded by the fact that the upper coils in the stack are usually the smaller and lightest coils.

The supports used in the base of batch coil annealing furnaces, currently in use with radial fans, must be strategically located within the base and aerodynamically designed. This design is necessary to minimize pressure drop and disturbance of the flow pattern of the wind in the immediate area of the fan.

Radial fans now in use are usually 24 inch O.D., with a motor capacity of 25 horsepower and capable of flows of about 5,000 to 10,000 standard cubic feet per minute. Even if radial fans are modified to operate at higher flow rates, a hot spot would develop in the upper coils for the reasons discussed above. There is a need in the art for a method of providing increased heating rates with uniform heat transfer to work items within the inner cover being heated in a furnace and, more particularly, a more rapid uniform method of heat transfer within the cover of a batch coil annealing furnace.

SUMMARY OF THE INVENTION

The present invention is a method and apparatus for heat treating at least one work item such as a coil, having an axial passage and being axially stacked on a base support means disposed within a cover means which is located on the base support means. The base support can be on the floor of a furnace and with the chamber of the furnace. A means to force the atmosphere such as an axial fan is located in the base. The atmosphere is forced axially from the base, up through an axial path including the axial passage of the at least one coil, through a top space between the top of the stack of coils and the top of the cover means, down through the annular space between the outside of the coils and the inside of the cover means, and back to the axial path through a base space, beneath the at least one coil, communicating from the annular space to the axial path. The support means is preferably a baseplate supported by a plurality of supports disposed on the bottom of the base. The supports need not have any particular configuration or design so long as there is a path for the atmosphere to return to the center of the base so that it might be recirculated back through the stack of coils. Preferably, the supports are distributed radially around the center of the base to help minimize the pressure drop of the atmosphere passing between them.

Thus, it is the general object of the present invention to provide an improved apparatus and method for uniformly and efficiently heat treating at least one work item, such as coils, which have an axial passage. It is another object of the present invention to uniformly and efficiently heat at least one coil in a batch coil annealing furnace. It is another object of the present invention to control the flow of atmosphere about at least one work item, having an axial passage, within a cover means, the work item being axially stacked on a base and the flow generally directed through the axial path including the axial passage, through an annular space between the outside of the work item and the cover means and back to the axial path. It is a feature of the present invention to force the atmosphere with the cover means by use of an axial fan located within the base. It is yet another feature of the present invention for the base to accommodate the axial fan. It is another feature of the present invention to have cooling tubes within the base in staggered rows to reduce the pressure drop of atmosphere flowing over the tubes.

It is the object of this invention to obtain one or more of the objects set forth above. These and other objects, features and advantages of this invention will become apparent to those skilled in the art from the following specification and claims, reference being had to the attached drawings.

BRIEF DESCRIPTION OF THE DRAWINGS

Elements in FIGS. 4–6 which are the same as elements in FIGS. 1–3 have corresponding reference characters plus 100.

DESCRIPTION OF THE PREFERRED EMBODIMENTS

Figure 2:
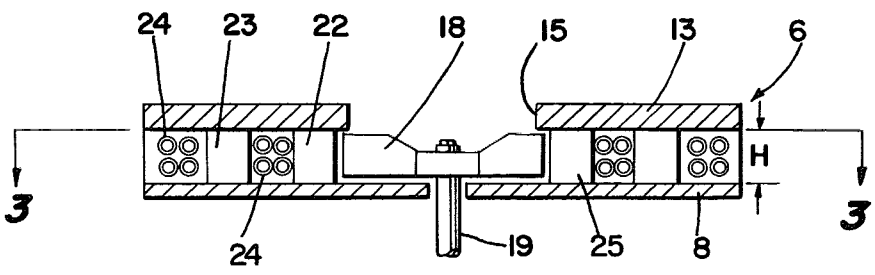
Fig. 2 PRIOR ART
FIG. 2 is a sectional view of the base of the batch coil annealing furnace shown in FIG. 1.
Figure 3:
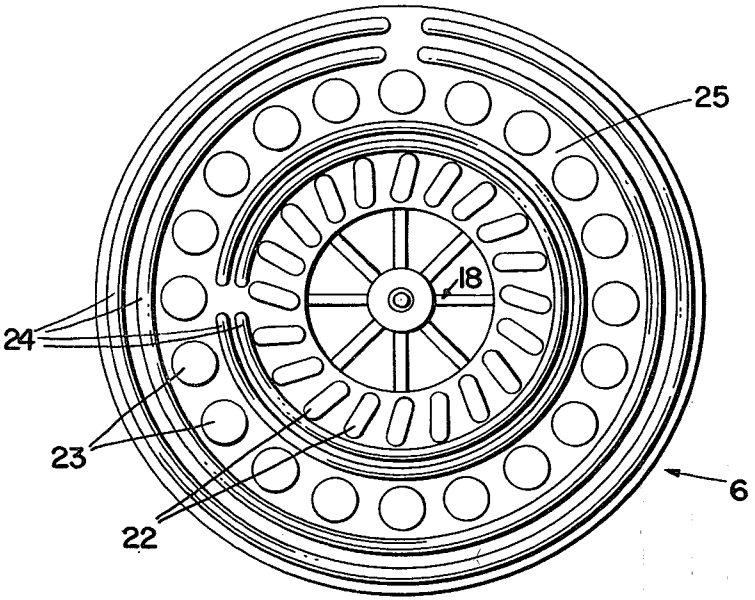
Fig. 3 PRIOR ART
FIG. 3 is a sectional view of the base of the batch coil annealing furnace of FIG. 2 along line 3—3.
Figure 1:
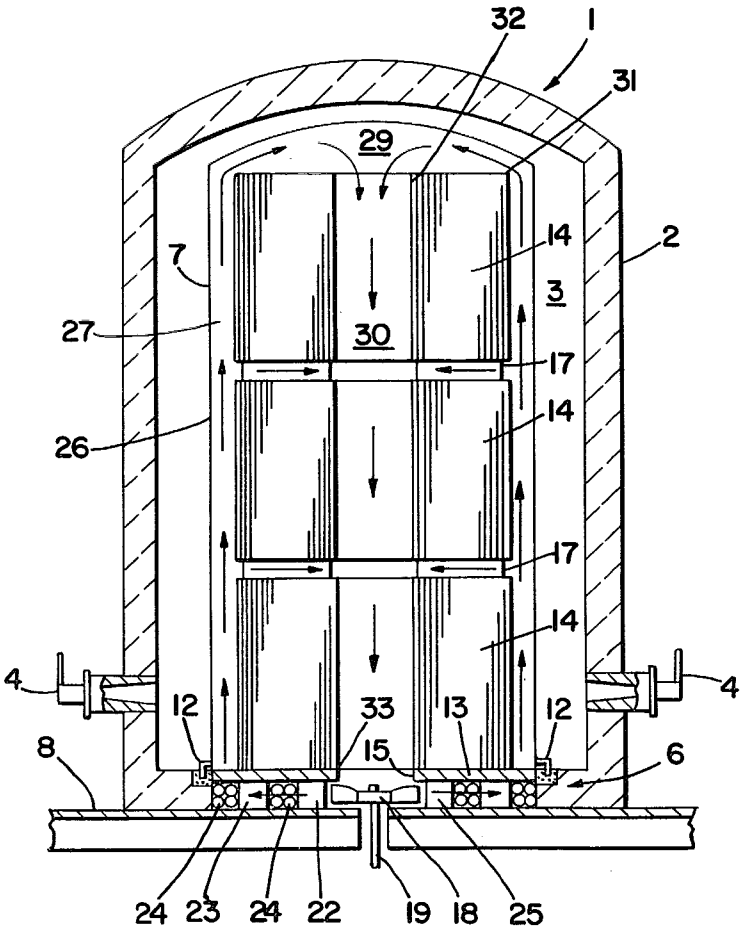
Fig. 1 PRIOR ART
FIG. 1 is a sectional view of a conventional batch coil annealing furnace showing the atmosphere circulation pattern with a radial fan.
Figure 5:
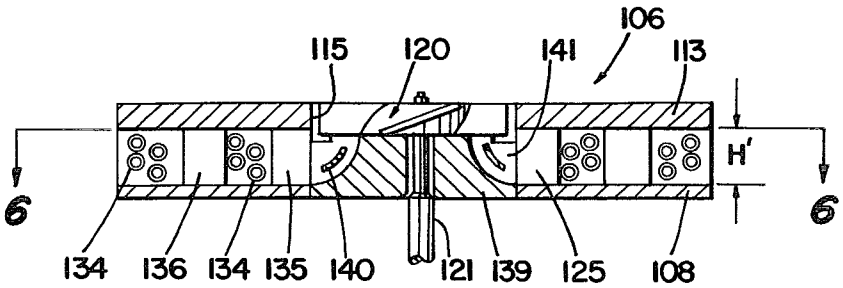
FIG. 5 is a sectional view of the base of the batch coil annealing furnace shown in FIG. 4.
Figure 6:
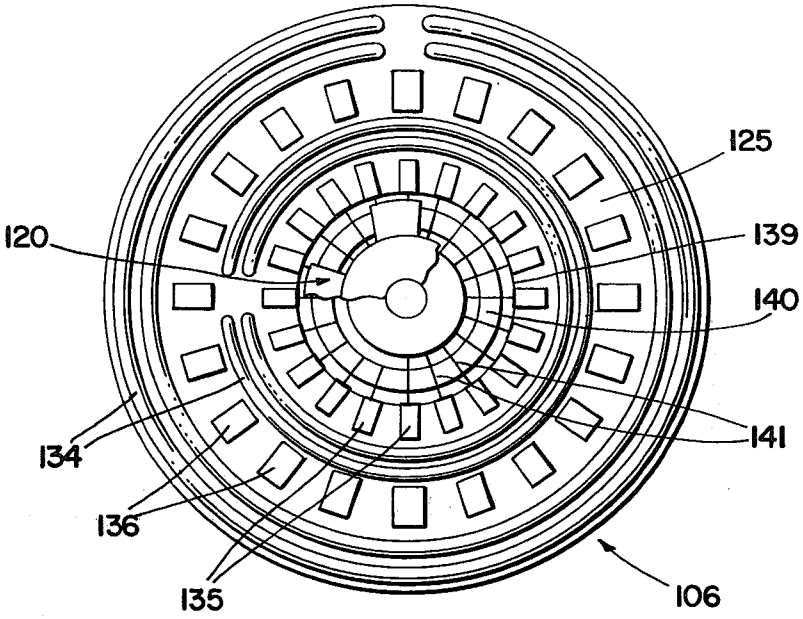
FIG. 6 is generally a sectional view of the base of the batch coil annealing furnace of FIG. 4 along line 6—6 with a partial view of the fan.
Figure 4:
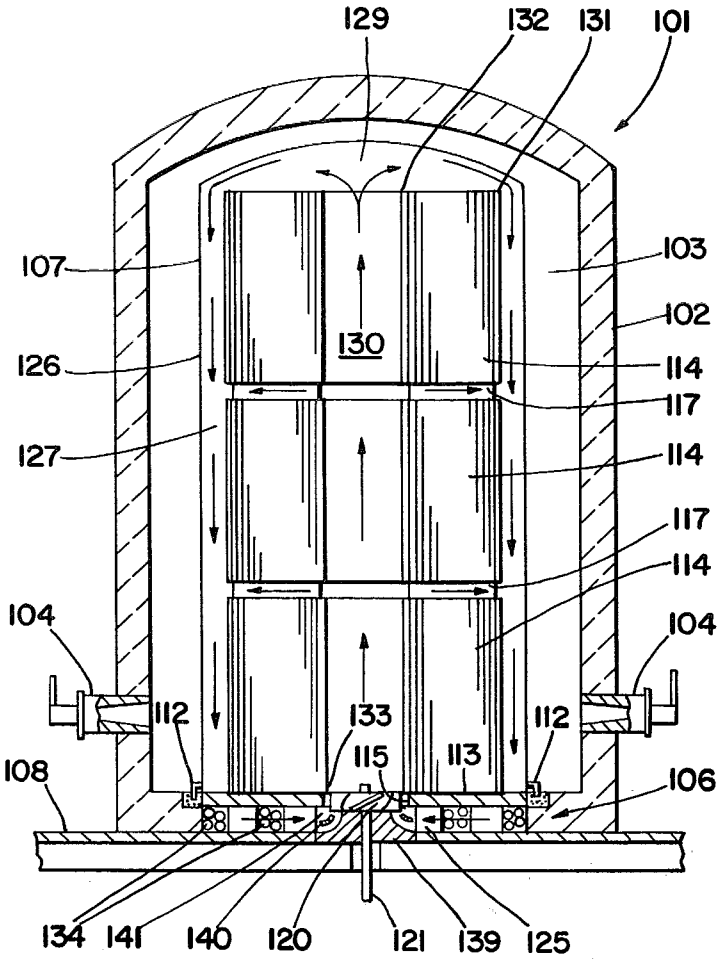
FIG. 4 is a sectional view of a batch coil annealing furnace of the present invention showing the atmosphere circulation pattern with an axial fan.

The present invention will be understood by those skilled in the art by reference to FIGS. 1–3 showing a prior art batch coil annealing furnace and FIGS. 4–6 showing one embodiment of the present invention in a batch coil annealing furnace.

In the prior art batch coil annealing furnace 1 as shown in FIGS. 1–3, heating chamber 3 is enclosed within outer wall 2. There is a heating means such as burners 4 to supply heat to heating chamber 3. Inner cover 7 is sealingly set on base 6 which is on the supporting floor 8 of the furnace 1. Suitable seals 12 are located between the base 6 and the inner cover 7. The seals 12 can be sand or a blanket-type seal of an insulation material such as a ceramic fiber. One ceramic fiber used is Kaowool. One or more work items such as coil 14 are axially stacked on a base support means such as baseplate 13 which is supported by diffuser supports 22 and general supports 23. Of course, any support means known in the art can be used. Each work item or coil 14 has an outside surface and an axial passage. When stacked the axis of the axial passage is generally perpendicular to the base 6. More than one coil 14 are stacked coaxially with other coils and the axial passages of the coils become a part of an axial path 30 through the stacked coils. Convector plates 17 can be placed between each coil 14 when more than one coil is being treated. The convector plates have an axial opening and passages communicating from the axial opening to an outside or circumferential surface to allow atmosphere to flow from the axial opening to the outside surface, i.e. flow in a radial direction. The axial opening is coaxial with the axial passages in the axial path 30.

A radial fan 18 is mounted on radial fan shaft 19 centrally located in base 6. Generally, the axis of the radial fan shaft 19 is coaxial with the axial path 30. The radial fan 18 communicates with the axial path 30 through axial baseplate opening 15. Radial fans commonly used are 24 inches in diameter, rated at 25 horsepower and capable of a flow of about 5,000 standard cubic feet per minute up to about 10,000 standard cubic feet per minute. When radial fans are used, the base supports must be strategically located and aerodynamically designed. Diffuser supports 22 and general supports 23 have particular design configurations. The diffuser supports 22 have rounded ends, are elongated and must be mounted in a particular direction. The general supports 23 are radially distributed concentrically about the inner diffuser supports and must be curved or round in cross section. This is important to minimize the pressure drop of the atmosphere which is forced from the radial fan 18 directly into the base space 25 between the baseplate 13 and the floor 8 in which the supports are located.

Cooling tubes 24 within the base 6 having a radial fan 18 are generally in an in-line configuration. An in-line configuration is a compact geometry such as a square cross-sectional distribution as shown in FIGS. 1 and 2. This compact geometry allows a minimum height H which is typically about 4 or 4½ inches. Although the pressure drop across the tubes 24 may be higher than if optimum cooling tube 24 configurations are used, the minimum height H allows a maximum wind velocity from the radial fan 18 into the annular space 27 between the cover wall 26 and the outside diameter of the coils 14.

Generally, an annealing process includes the steps of heating, soaking and cooling. During the heat treating operation, the atmosphere is circulated within the inner cover 7 and around the coils 14 by the radial fan 18 in the base 6. The direction of the atmosphere is indicated by the arrows in FIG. 1. The atmosphere is forced radially from the radial fan 18, through base space 25 between the baseplate 13 and the floor 8, and between the diffuser supports 22, the general supports and the cooling tubes 24. The atmosphere passes up through the annular space 27 between the inner cover wall 26 and the outside of the coils 14, into the top space 29 between the top of the inner cover and the top of the top coil, down through the axial path 30 of the coils and back to the radial fan 18. Additionally, atmosphere passes from annular space 27 to axial path 30 through convector plates 17.

The use of a radial fan in the base 6 to circulate air within the inner cover 7 about the work items to be treated provides an improvement in heat transfer and temperature uniformity during the heating process. However, there is still some non-uniform heating of the work items which limits the rate at which heat transfer processes, particularly heating, can take place. Coil hot spots occur on the top outside edge 31 of the top coil are caused by both convection and radiation. The top outside edge 31 of the top coil is exposed to both the top of the inner cover and the side of the inner cover resulting in more radiant heat to that area than to other areas receiving radiant energy from the inner cover walls. The convection path as shown by the arrows in FIG. 1 also results in non-uniform heating of the coil stack and contributes to a hot spot in the top outside edge 28 of the top coil. Atmosphere from the radial fan 18 is heated as it is forced up along the wall between the inner cover and the coils. The atmosphere is heated to its maximum by the time it reaches the top outside edge 31 of the top coil reinforcing the hot spot. The hot atmosphere then moves into top space 29 between the top of the inner cover and the top coils and down through the axial path 30. The atmosphere is hottest at the top coil and gives up its heat non-uniformly as it goes back down toward the radial fan 18. Therefore, the lower inside corner 33 of the bottom coil receives the least amount of heat as compared to the top outside corner 31.

The temperature to which the inner cover 7 may be heated is limited since the top outside edge 31 and outside surface of the coils cannot be overheated in order for the lower inside corner 33 and inside surface of the coil to more rapidly receive sufficient amounts of heat to be brought up to the proper temperature for annealing. This problem is compounded by the fact that the upper coils in the stack are usually the lightest coils. Having less mass they heat up faster than the lower coils in the stack. Thus, even using the radial fan to circulate the atmosphere within the inner cover the temperature to which the cover may be heated is limited and non-uniformities still occur. In addition to non-uniform heat treatment, non-uniform axial and radial gradients can cause the wraps in the coils to warp and stick.

It is of interest to note that increasing the flow rate of the radial fans is one means by which more uniform heating can be achieved. By increasing the flow rate air moves more rapidly through the annular space 27 between the inner cover wall 26 and the coils. The air passing over the hot outside top corner of the top coil picks up heat and brings the heat into the axial path inside the coils. Even with the increased rates using the radial fan 18, a hot spot nevertheless develops at the top outside corner of the top coil.

The present invention is an apparatus and method for heat treating at least one work item with each item having an axial passage, such as one or more metal coils. The at least one coil is axially stacked on a base support means in a cover means such as an inner cover. When there is more than one coil, the coils are coaxially stacked with the axial passage of each coil forming part of an axial path. There is a means to force atmosphere within the inner cover up through the axial path around the outside surface of the work and back to the means to force the atmosphere. Heat is applied to the coils within the inner cover. Preferably, the inner cover sealingly covers the work within a heating chamber. The inner cover is heated and heat is transferred to the work from the inner cover. The method and apparatus of the present invention is particularly applicable for heat treating metal coils in batch coil annealing furnaces. A preferred embodiment of the present invention is the batch coil annealing furnace shown in FIGS. 4–6 and its method of operation. However, this particular embodiment should not be considered a limitation on the scope of the present invention.

The annealing furnace shown in FIG. 4 has an outer furnace wall 102 within which there is a heating chamber 103. Heating chamber 103 can be heated by any suitable means known in the art such as burners 104 which can introduce hot combustion gases into the heating chamber 103. Within the heating chamber 103 can be inner cover 107 which sealingly sits on base 106 which is supported on a supporting floor such as furnace floor 108. Any suitable sealing means 112 can be used to form a seal between inner cover 107 and base 106 such as sand or an insulation material such as ceramic fiber. One ceramic fiber which can be used is Kaowool.

A radial fan 18 is used in the prior art batch coil annealing furnace 1. In the annealing furnace 101 used to illustrate the present invention, the preferred means to force atmosphere is an axial fan 120 located in the base 106. The use of the axial fan 120 results in a modified base and an improved method of operation.

The axial fan 120 is mounted on axial fan shaft 121 which is located along the central axis of the base 106. Base space 125 is between the baseplate 113 and the floor 108. A fairing 139 can be axially mounted in the base 106 directly beneath the axial fan 120 to help axially direct atmosphere, passing from base space 125 to the axial fan 120. A turning vane 140 can be concentrically mounted about the fairing 139. The turning vane 140 helps to axially direct the atmosphere passing from the base space 125 to the axial fan 120. A plurality of straighteners 141 can be uniformly disposed about and connected to the turning vane 140 to help prevent the atmosphere passing from the base space 125 to the axial fan 120, from swirling helically about an axis through the axial fan shaft 121.

A comparison of axial and radial fan performance can be made based on the specific speed. The specific speed is equal to the rotational speed of the fan times the square root of the flow rate divided by the pressure to the three-fourths power. Axial fans are suited for high specific speed operation, that is, high flow rates at low pressures. Radial fans are better suited for low specific speed operation, that is, low flow rates at high pressures. Base 106, having an axial fan 120, should be designed for minimum pressure drop at higher flow rates. The height H′ of the base space 125 when using axial fan 120 should be greater than corresponding height H when using radial fan 18. This is because a larger flow through area in the base space 125 is required to accommodate the greater flow rate and lower pressures when using an axial fan.

The base can also be designed to accommodate the fairing 139, turning vane 140, and straighteners 141 which are preferably used with the axial fan 120. This requires height H′ to be somewhat greater than height H which was used with the base 6 of the batch coil annealing furnace having a radial fan as shown in FIG. 2. Preferably, height H′ is between 7 and 10 inches. With this additional height the configuration of cooling tubes 134 can be designed for optimum heat transfer and wind flow characteristics. A preferred design is the staggered configuration shown in FIGS. 4 and 5. The staggered tube configuration permits the advantage of more uniform exposure to the flowing atmosphere within the base 106 for better heat transfer and also results in a lower pressure drop. This is particularly important when using axial fans which characteristically do not develop high static pressures, and system resistance is desired to be at a minimum.

In a batch coil annealing furnace of the present invention, there is a support means such as baseplate 113 supported by a plurality of inner supports 135 and outer supports 136. One or more coils 114 are coaxially stacked on baseplate 113. When using the axial fan 120 located in the base 106 as a means to force air, the axial path 130 through the axial passages of the at least one coil is aligned with the axial fan 120 so that atmosphere is forced from the base 106 through the axial path 130. When using an axial fan 120 it is not necessary to strategically locate or particularly aerodynamically design inner supports 135 and outer supports 136 in the manner necessary with diffuser supports 22, and outer supports 36 when using a radial fan. Preferably, inner supports 135 and outer supports 136 are radially disposed about the axis of base 106 to minimize wind pressure drop.

An additional advantage of the use of an axial fan to promote the atmosphere circulation method of the present invention is that an axial fan can be retrofitted into an existing batch coil annealing furnace base.

The direction of atmosphere flow within inner cover 107 of the present invention is reverse of that in prior art furnaces. In the operation of the present invention, atmosphere is forced up through the axial path 130 through the inside passages of the coils 114. The atmosphere then moves between the top of the inner cover and the top of the coils in top space 129, down through the annular space 127 between the outside of the coils 114 and the inner cover wall 126 of inner cover 107, through a base space 125 between the baseplate 113 and the floor 108. Where there is more than one coil 114 axially stacked, atmosphere also passes from axial path 130 to annular space 127 through convector plates 117 stacked between coils 114 in a similar manner, but in a reverse direction, to baseplate 17 of FIG. 1.

The direction of atmosphere flow of the present invention results in the uniform heating of one or more coils. The atmosphere decreases in temperature while traveling from the base 106 through the axial path 130. Upon reaching the top inside edge 132 of the top coil 2, the temperature of the atmosphere is at a minimum in the recirculation path. At this lower temperature it transfers less heat to the top inside edge 132 and top outside edge 131. The atmosphere upon passing through top space 129 above the top coil and down along the outside edge 131 of the top coil actually slows down the heating rate by removing heat. In this way the limiting hot spot at the outside edge 131 of the top coil is counteracted. The atmosphere travels downward through annular space 127 removing heat from the inner cover and the outside coil surface, and increasing the temperature. The heated atmosphere transfers heat to the coils as it passes through base space 125. The lower inside corner 133 is exposed to the heated atmosphere being forced by axial fan 120 into axial path 130. Therefore, the direction the atmosphere is forced moderates the hot spot in the top outside corner 131 and the cold spot in the lower inside corner 133. Because there is a more uniform heating of the coils, the temperature within the inner cover can be increased for more rapid heat treating.

The maximum temperature of the inside of the inner cover 107 is determined by two factors: the peak temperature of the coils in the inner cover; and the temperature gradients in the inner cover and the coils. Large gradients in the inner cover can cause it to deform due to the thermal stresses, and large gradients in the coil can cause sticking of the coil wraps. Given these limitations, higher heat fluxes can be applied only when heat is distributed more evenly over the surface of the coil. Therefore, by using the direction of atmosphere flow with the present invention, the temperature gradients in the inner cover and coils are reduced and higher temperatures can be used reducing heating time.

In the heating cycle radiation is the prominent mode of heat transfer in a batch coil annealing furnace. More uniform heating by the use of atmosphere direction of the present invention further enables more efficient heat transfer by the use of higher atmosphere velocities. Higher atmosphere velocities are more effective in the cooling mode. Higher atmosphere flow rates can be used than have been used in conventional batch coil annealing furnaces. For example, flow rates between 10,000 and 25,000 standard cubic feet per minute can be used without resulting in hot spots because of the reverse flow pattern acting as a means to promote uniform heating of the coils. As with batch coil annealing furnaces in the prior art, convector plates 117 can be used even with the greater flow rates to additionally promote more uniform heat transfer. Presently, the flow rates are only limited by the state of the fan art.

Axial fans generally do not develop high static pressures and the resistance in the system should be kept to a minimum. As noted in the description of the structure of the base containing an axial fan as described above, the height H is increased allowing a staggering of the cooling tubes 134. By increasing this height H and staggering the cooling tubes, the pressure drop across the base can be minimized. Although with the use of the axial fan, the supports 135, 136 do not have to be particularly disposed within the base or have a particular design and it is preferred that they be in a radial position for a minimum pressure drop of the atmosphere as it moves back through the base to the axial fan.

Experimental tests with a 24 inch Buffalo Forge 4 blade axial fan in the base of a batch coil annealing furnace of the type shown in FIG. 4, resulted in 16,000 cubic feet per minute and a pressure head of 3 inch water column at 3200 revolutions per minute. The axial fan is operated at less than 30 horsepower. Although a discharge diffuser at the fan outlet is not necessary to the present invention, the use of the discharge diffuser resulted in greater flow rate for a given amount of horsepower. It is estimated that cycle time reduction as high as 33% can be attained using an axial fan in place of a radial fan at the same flow rate in the base of a batch coil annealing furnace. Axial fan speed is limited by thermal stress, and the allowable stress decreases with increasing temperature. If higher flow rates are desired which require speeds that are temperature limited, a two speed fan may be used. Higher flow rates would be used during heating and cooling and the slower flow rates during the soak. If speeds other than standard motor speeds are to be used, separate fan shafts and motor units can be used. The speeds can be obtained by selecting proper pulley ratios.

Conventional batch coil annealing furnaces use sand seals between the inner cover and the base. The use of the high flows and reverse direction of the present invention could result in sand pickup from open sand seals. This can be overcome by the use of a baffle to divert atmosphere from the sand or to use the metal-to-metal sand seal or a blanket seal. The blanket seal is a modified sand seal with a reinforced ceramic fiber liner, such as Kaowool, used in place of sand. Although the blanket deforms and must be regularly replaced, it completely eliminates coil damage due to sand pickup.

The increased atmosphere flow rate potential with an axial fan has a greater affect on the cooling cycle than the heating. As noted the heating cycle is controlled more by radiant heat than by convection heat modes. In the beginning of the cooling cycle, the inner cover 107 radiates heat to the surroundings and the outside surface of each coil radiates heat to the inner cover 107. Because of the small quantity of thermal inertia possessed by the inner cover 107 and the low radial conductivity of the outside surface of each coil, the inner cover and each coil cool rapidly to temperatures which make radiant heat transfer ineffective. The convective heat transfer coefficient is greater during the cooling cycle than the heating cycle. This is due to the fact that the average temperature of the atmosphere during cooling is considerably less than it is during heating. Assuming a constant velocity of gas movement, the convective heat transfer coefficient increases as the gas temperature decreases. Therefore, increased atmosphere rates are more effective in reducing cooling time then heating time. The high flow rate of the axial fan in comparison to the radial fan results in a more rapid cooling cycle.

Therefore, the present invention provides an improved circulation pattern and an increased recirculation flow rate within the inner cover to increase the heating and cooling rates of the coils and reduce the cycle time. To accomplish this with the radial flow fan of the prior art requires the fan size or speed to be increased. This has been attempted with little success.

Modifications, changes, and improvements to the preferred forms of the invention herein disclosed, described and illustrated may occur to those skilled in the art who come to understand the principals and precepts thereof. Accordingly, the scope of the patent to be issued hereon should not be limited to the particular embodiments of the invention set forth herein, but rather should be limited by the advance of which the invention has promoted the art.

What is claimed is:

1. An apparatus for heat treating a work item that has a longitudinally extending axial passageway, such as a coil of metal, comprising:

(a) a vertically elongated space for receiving at least one work item which is positioned therein such that the axial passageway thereof is vertically oriented;

(b) a generally horizontally disposed baseplate on which the work unit is supported in the space, the baseplate having a center opening in substantial alignment with the axial passageway of the work unit when properly positioned on the baseplate;

(c) an axial flow fan mounted adjacent the baseplate for directing gas vertically upwardly through the opening of the baseplate and axial passageway of the work unit, the fan being rotatable about an axis which is generally normal to the plane of the baseplate;

(d) a fairing adjacent the fan for directing gas through an annular opening formed between the fairing and center opening of the baseplate, the fairing having an annular curved surface which is concentric with the rotational axis of the fan and generally curved inwardly towards the rotational axis of the fan for directing gas vertically upwardly through the annular opening;

(e) at least one annular turning vane disposed adjacent the annular opening and around the fairing in spaced relation from the curved surface thereof for directing gas through a portion of the annular opening farthest from the fairing, the vane having an annular curved surface that is also generally curved inwardly toward the rotational axis of the fan; and (f) a plurality of straighteners radially oriented about the fairing adjacent the concave surface thereof to prevent the swirling of gas about the rotational axis of the fan as the gas passes through the annular opening into the axial passageway of the work unit.

2. The apparatus of claim 1, which includes means for heating a work item positioned on the baseplate within the space.

3. The apparatus of claims 1 or 2, which includes means adjacent the baseplate for cooling gas, prior to the circulation thereof through the annular opening into the axial passageway of the work unit.

4. The apparatus of any preceding claim, wherein the axial fan operates at about 3200 revolutions per minute to produce a forced atmosphere at about 1600 scfm with a pressure head of about 3" W.C.

* * * * *